US005540043A

United States Patent [19]

Raasch

[11] Patent Number: 5,540,043

[45] Date of Patent: Jul. 30, 1996

[54] ROTOR SPINNING APPARATUS WITH SPINNING BOX DIRT SEPARATOR

[75] Inventor: Hans Raasch, Mönchengladbach, Germany

[73] Assignee: W. Schlafhorst AG & Co., Moenchengladbach, Germany

[21] Appl. No.: 273,861

[22] Filed: Jul. 12, 1994

[30] Foreign Application Priority Data

Jul. 12, 1993 [DE] Germany ..... 43 23 213.2

[51] Int. Cl.[6] ..... D01H 11/00; D01H 4/00

[52] U.S. Cl. ..... 57/301; 57/304; 57/404; 57/406; 57/407; 57/408; 57/412

[58] Field of Search ..... 57/301, 302, 304, 57/305, 404, 406, 407, 408, 412

[56] References Cited

U.S. PATENT DOCUMENTS

| | | | |
|---|---|---|---|
| 4,109,51 | 8/1978 | Yamada et al. | 57/407 |
| 3,884,027 | 5/1975 | Schummann et al. | 57/301 |
| 3,884,028 | 5/1975 | Stahlecker et al. | 57/301 |
| 3,918,248 | 11/1975 | Suzuki | 57/407 |
| 3,922,840 | 12/1975 | Watanabe et al. | 57/407 |
| 3,927,516 | 12/1975 | Stahlecker | 57/407 |
| 4,038,812 | 8/1977 | Stahlecker | 57/304 |
| 4,204,391 | 5/1980 | Clayton | 57/406 |
| 4,753,067 | 6/1988 | Landwehrkamp et al. | 57/407 |
| 4,763,465 | 8/1988 | Raasch | 57/406 |

FOREIGN PATENT DOCUMENTS

| | | |
|---|---|---|
| 0197442 | 7/1989 | European Pat. Off. . |
| 2012278 | 10/1970 | Germany . |
| 2314229 | 1/1976 | Germany . |
| 3417567 | 11/1984 | Germany . |
| 3636182 | 4/1988 | Germany . |

*Primary Examiner*—William Stryjewski
*Attorney, Agent, or Firm*—Herbert L. Lerner; Laurence A. Greenberg

[57] ABSTRACT

A rotor spinning apparatus includes a support frame stationarily disposed on a frame of a spinning machine. A bearing is disposed on the support frame. A spinning rotor is disposed on the bearing and has a rotor axis and a rotor opening. A rotor housing surrounds the spinning rotor. A lid element is rotatably supported about a pivot axis. The pivot axis is oriented orthogonally to the rotor axis and is disposed approximately vertically beneath the rotor opening. The lid element covers the rotor housing and has a sliver feed roller, an opening roller, a fiber guide channel plunging into the rotor opening, a yarn draw-off opening, and a dirt separator.

12 Claims, 3 Drawing Sheets

ROTOR SPINNING APPARATUS WITH SPINNING BOX DIRT SEPARATOR

BACKGROUND OF THE INVENTION

Field of the Invention

The invention relates to a rotor spinning apparatus having a support frame disposed in a stationary fashion on a frame of a spinning machine, the support frame has a bearing with a spinning rotor and a rotor housing, and a pivotably supported lid element covers the rotor housing and has a sliver feed roller, an opening roller, a fiber guide channel plunging into the rotor opening, and a yarn draw-off opening.

Rotor spinning apparatuses of the generic type described above are known, for instance, from German Published, Non-Prosecuted Application DE 36 36 182 A1. That reference describes a spinning box with a rotor housing to which suction is applied, which is secured to the machine frame, and in which a spinning rotor revolves while being supported on support disks. The rotor housing is closed off at the front in air-tight fashion by a channel plate, which is disposed on a lid element and has an attachment engaging the rotor.

In addition to a sliver feed roller with a relatively long drive flange and a worm wheel disposed on the end, the pivotably supported lid element has an opening roller driven by a tangential belt through a drive wharve, and a one-piece fiber guide channel extending between the opening roller and the spinning rotor. The pivot axis of the lid element is located in a rear region of the spinning box, preferably above the drive shaft of the sliver feed roller. In order to carry out maintenance work, for instance, the spinning box can be opened. In that case, the lid element is unlocked and folded upward about the pivot axis. When the lid element is pivoted, both the drive wharve of the opening roller and the worm wheel disposed on the end of the sliver feed roller come out of engagement with the associated drive means. In other words, they lose contact with a revolving tangential belt or worm that is disposed on a drive shaft extending longitudinally of the machine. The sliver opening device therefore comes to a stop. At the same time, braking of the spinning rotor is initiated through a lever linkage.

A disadvantage of such spinning boxes is above all the installed position of the pivot axis. Since it is located relatively far behind the rotor, that leads to unfavorable geometrical conditions and thus to certain problems upon pivoting of the channel plate extension into the rotor opening, wherein the channel plate extension has the fiber guide channel mouth.

In such known configurations difficulties also arise if a dirt separator is to be installed.

European Patent No. 0 197 442 B1 describes various models of pivotable spinning boxes. Spinning boxes are shown that have a one-piece basic housing, which accommodates all of the spinning components, which can be pivoted as a unit and which can be closed by a simple covering, as well as spinning devices made up of two main structural units. A first main structural unit is formed by a support frame that not only has a support disk bearing for the rotor shaft but also has the rotor housing which is open at the front. That structural unit is pivotably supported about a horizontal axis of rotation located above the rotor housing. A second main structural unit includes a lid element that closes the rotor housing. Besides the sliver feed roller, that lid element has an opening roller and a one-piece fiber guide channel. The pivot axis of the lid element is formed by a drive shaft for sliver feeding that extends longitudinally of the machine. Since in such spinning boxes the pivot axis of the lid element is also located far behind the rotor mouth, the aforementioned problems arise in that case as well.

SUMMARY OF THE INVENTION

It is accordingly an object of the invention to provide a rotor spinning apparatus, which overcomes the hereinaforementioned disadvantages of the heretofore-known devices of this general type.

With the foregoing and other objects in view there is provided, in accordance with the invention, in a spinning machine having a frame, a rotor spinning apparatus, comprising a support frame stationarily disposed on the frame of the spinning machine; a bearing disposed on the support frame; a spinning rotor being disposed on the bearing and having a rotor axis and a rotor opening; a rotor housing surrounding the spinning rotor; and a lid element being rotatably supported about a pivot axis, the pivot axis being oriented orthogonally to the rotor axis and being disposed approximately vertically beneath the rotor opening, the lid element covering the rotor housing, and the lid element having a sliver feed roller, an opening roller, a fiber guide channel plunging into the rotor opening, a yarn draw-off opening, and a dirt separator.

The disposition of the pivot axis in accordance with the invention has the advantage of only subjecting the channel plate attachment having the fiber guide channel mouth and being disposed on the lid element to very slight vertical offsetting upon being pivoted into the rotor opening. In other words, the channel plate extension slides horizontally and virtually rectilinearly into the rotor opening. This rectilinear inward pivoting of the channel plate extension makes it possible to position the fiber guide channel mouth at a slight distance away from the fiber chute wall of the rotor, which is especially advantageous with a view toward bringing drafted individual fibers onto the fiber chute wall and has a positive effect on the outcome of spinning. The special disposition of the pivot axis also makes it possible to integrate a dirt separator directly into the lid element and thus produce a very compact, easily accessible rotor spinning apparatus.

In accordance with another feature of the invention, the dirt separator has a dirt chamber disposed beneath the opening roller, and the dirt chamber is connected through a short connection piece at the rear to a dirt removal suction line that communicates through a filter chamber with a negative pressure source. The chosen disposition of the coupling point of the connection piece and the dirt removal suction line above the pivot axis, and the specialized embodiment thereof, have the effect of permitting the lid element to be opened very wide, which makes for Very easy maintenance of the spinning box. Moreover, with this kind of embodiment of the dirt separator device, handling of the lid element, for instance for replacement because of wear, is in no way impaired.

In accordance with a further feature of the invention, the dirt chamber connection piece, which is pivotable with the lid element, and the dirt removal suction line secured stationarily to the machine frame, have flange-like end regions with sealing means adapted to one another, which assure that in the operating state, in other words with the spinning box closed, the dirt chamber disposed beneath the opening roller is connected automatically to the suction device of the spinning machine.

In accordance with an added feature of the invention, the support frame receiving the rotor housing and the support disk bearing is fixed to the basic frame of the spinning machine through lateral box walls.

In accordance with an additional feature of the invention, the box walls have outriggers being cantilevered forward on their lower surfaces, and the lid element is pivotably secured to the outriggers through metal fittings.

In accordance with yet another feature of the invention, the pivot axis is constructed as short bolts or the like.

In accordance with yet a further feature of the invention, the bolts extend through slit recesses that are disposed in lateral fastening tabs of the lid element and are secured by securing means that close the slit recesses at the front.

The lid element can easily be disassembled in the open state, once the securing means have been loosened, and replacement is impaired neither by the pivot axis nor by the rear connection pieces for the individual dirt separator.

In accordance with yet an added feature of the invention, the pivot axis or the spinning box drives, which are preferably disposed at the same height and one behind the other, are disposed in such a way as to provide enough space below the support disk bearing or above the pivot axis for a dirt removal suction line and its coupling device for coupling to the connection piece of the dirt chamber disposed in the pivotable lid element.

In accordance with a concomitant feature of the invention, there is provided a tangential belt acting upon the drive wharve of the opening roller from below and being disposed between the pivot axis and a parallel drive shaft along the machine, for sliver feeding.

Other features which are considered as characteristic for the invention are set forth in the appended claims.

Although the invention is illustrated and described herein as embodied in a rotor spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
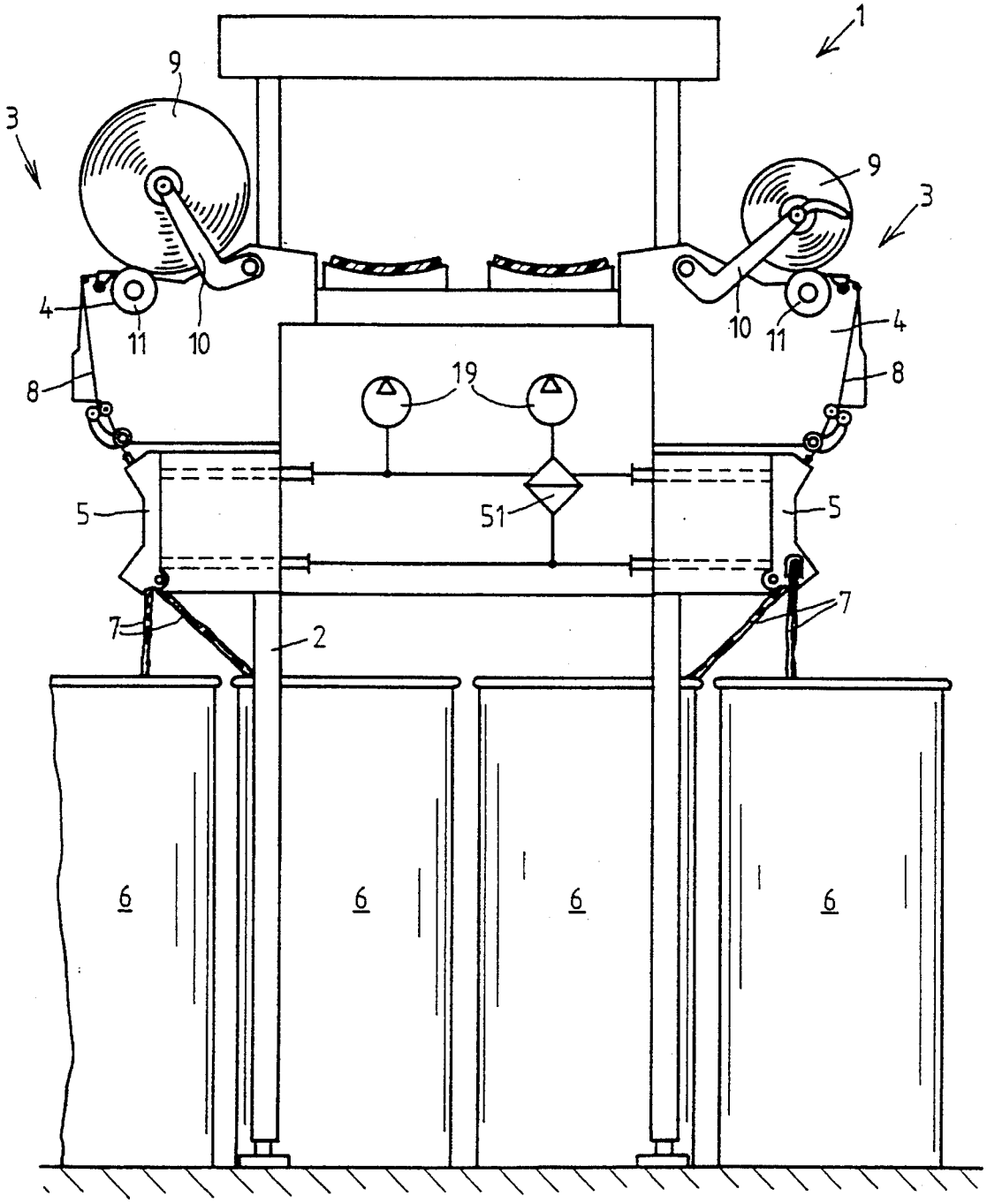
FIG. 1 is a fragmentary, diagrammatic, side-elevational view of an open end spinning machine with rotor spinning apparatuses disposed on both sides.

Referring now to the figures of the drawing in detail and first, particularly, to FIG. 1 thereof, there is seen an automatic bobbin winder, which is identified overall by reference numeral 1. Automatic bobbin winders of this kind have a central machine base frame 2, on both sides of which work stations 3 are disposed. The essential components of each work station 3 are a bobbin winding assembly 4 and a rotor spinning apparatus 5. The rotor spinning apparatuses 5 process sliver 7, which is stored beforehand in spinning cans 6, into a yarn 8. The yarn 8 is wound into a cross-wound bobbin or cheese 9 on the bobbin winding assemblies 4. As is indicated, the cheese 9 is retained in a creel 10 during the winding process and is acted upon by a drive shaft 11, which revolves at approximately a yarn draw-off speed.

Figure 2:
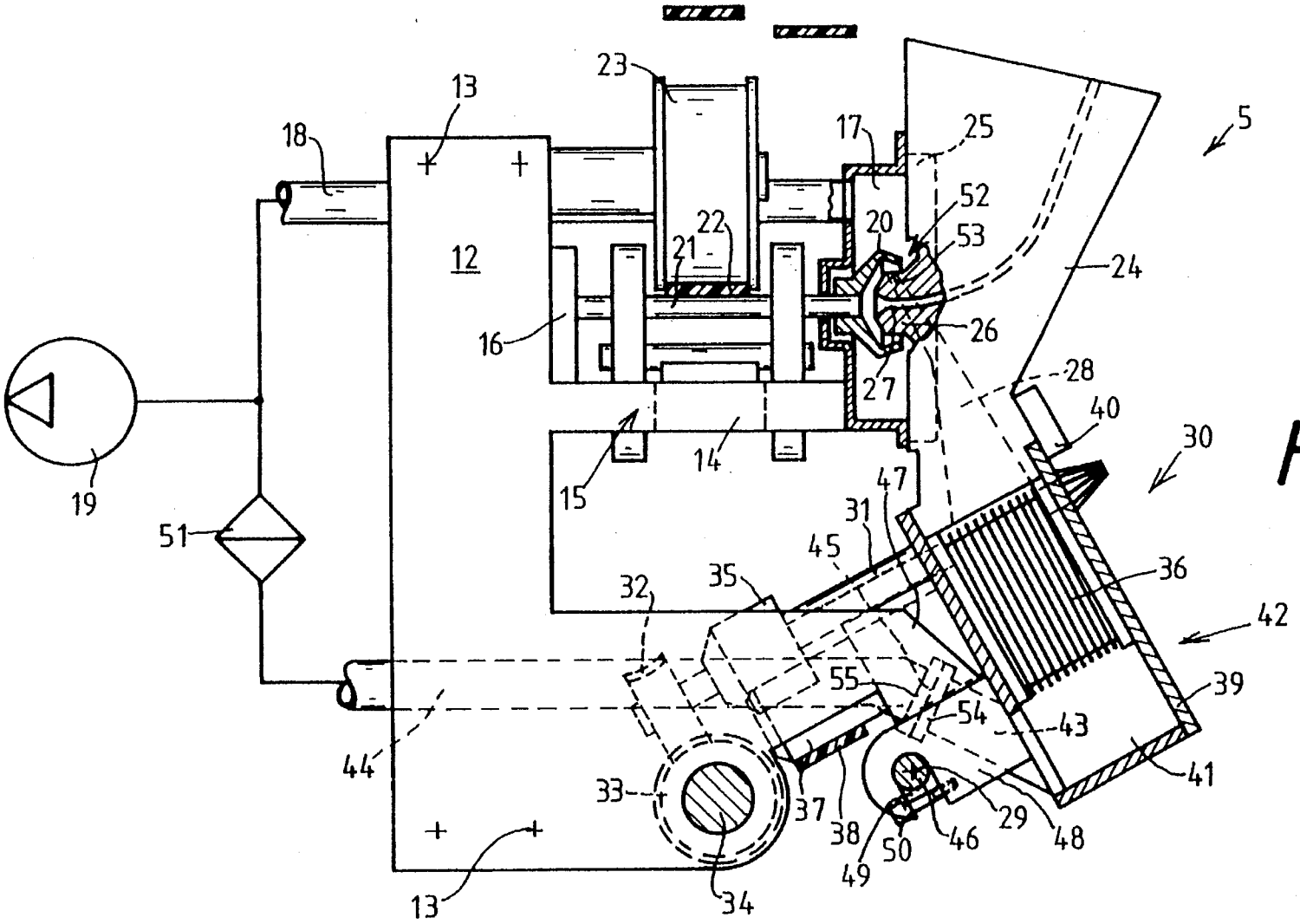
FIG. 2 is a partly sectional view of a rotor spinning apparatus according to the invention in an operating position.
Figure 3:
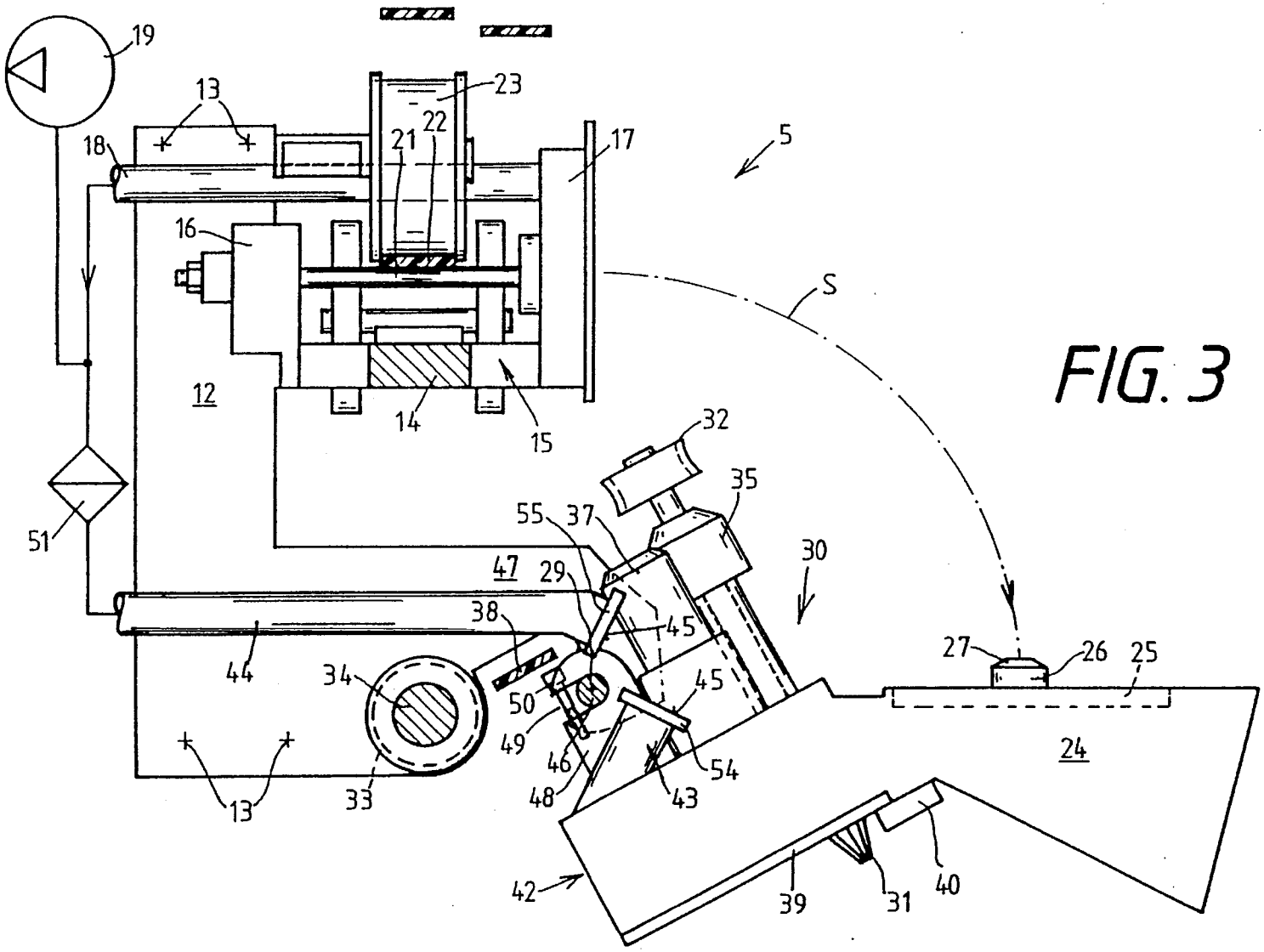
FIG. 3 is a view similar to FIG. 2 of the rotor spinning apparatus in an open state.

As is shown in FIGS. 2 and 3, the rotor spinning apparatuses 5 have a support frame 14, which is secured in stationary fashion to the base frame 2 of the machine through box walls 12 and corresponding fastening elements 13. Disposed on this support frame 14 are not only a support disk bearing configuration 15 but an axial bearing 16 and a rotor housing 17. A spinning rotor 20 revolves in the rotor housing 17, which is connected to a negative pressure source 19 through a section line 18, and the spinning rotor is supported by a rotor shaft 21 thereof in a wedge-shaped gap between two pairs of support disks. The rotor shaft 21 is acted upon in the usual way by a lower run or race of a tangential belt 22 which is moved into position by a pressure roller 23.

The rotor housing 17, which is open at the front, is sealed off by a channel plate 25 secured in a lid element 24. The channel plate 25 has a centrally disposed extension or attachment 26 that protrudes past the channel plate 25 at the front. A yarn draw-off opening or nozzle 27 and a mouth region of a fiber guide channel or conduit 28 are disposed in the attachment 26.

The lid element 24, which is movably supported on a pivot axis 29, has not only the channel plate 25 but also sliver opening components 30. A sliver feed roller 31 has a worm wheel 32 disposed on its end which meshes with a worm 33 of a drive shaft 34 extending longitudinally of the machine and can be turned on in defined fashion through an electrical coupling 35. Not only the sliver feed roller 31 but also an opening roller 36 and the one-piece fiber guide conduit or channel 28 are disposed in the lid element 24. A wharve 37 of the opening roller 36 is driven by the lower run or race of a tangential belt 38.

A housing of the opening roller and a dirt chamber 41 disposed beneath the opening roller 36, are closable by a lid 39 that is secured by a latch 40. The dirt chamber 41, as part of an individual dirt separator 42, is disposed beneath the opening roller 36 and is connected through a rear connection piece 43 to a dirt removal suction line 44, which in turn communicates with the negative pressure source 19 through a filter chamber 51. A coupling region 45 of these two lines is located just above the pivot axis 29, when the spinning box is closed, as is shown in FIG. 2. The coupling region 45 has respective flange-like end regions 54 and 55 of the connection piece 43 and the line 44 with sealing means being adapted to one another.

The pivot axis 29, about which the lid element 24 is tiltably supported, as is suggested in FIG. 3, is preferably constructed as short bolts 46, which are disposed in forward-projecting outriggers 47 of the box walls 12. The bolts 46 engage slit-like recesses 49, which are disposed in fastening tabs 48 of the lid 24. The bolts 46, which are rotatably retained in the slit-like recesses 49, are locked by securing means 50.

The lid element 24, which is pivotable in a direction S as is shown in FIG. 3, can easily be disassembled as a unit after the securing means 50 have been loosened, without hindrance from the pneumatic dirt removal suction device or dirt separator 42. The disposition of the pivot axis 29 approximately vertically beneath a rotor opening 52 having a groove 53 according to the invention, moreover means that a vertical offset that must be taken into account when the channel plate extension or attachment 26 is pivoted inward is very slight, and therefore the mouth region of the fiber guide channel 28 can be located very close to a fiber chute wall of the rotor 20, which has a very positive effect on the outcome of spinning.

I claim:

1. In a spinning machine having a frame, a rotor spinning apparatus, comprising:

a support frame stationarily disposed on the frame of the spinning machine;

a bearing disposed on said support frame;

a spinning rotor being disposed on said bearing and having a rotor axis and a rotor opening;

a rotor housing surrounding said spinning rotor;

a lid element pivotally supported about a pivot axis, said pivot axis being oriented orthogonally to said rotor axis and being disposed approximately vertically beneath said rotor opening, said lid element covering said rotor housing, and said lid element having a sliver feed roller, an opening roller, a fiber guide channel plunging into said rotor opening, a yarn draw-off opening, and a dirt separator;

a negative pressure source, and a dirt removal suction line connected to said negative pressure source, said dirt separator having a dirt chamber disposed beneath said opening roller, said dirt chamber permanently communicating with said dirt removal suction line during a spinning operation.

2. The rotor spinning apparatus according to claim 1, including a rear connection piece connected to said dirt removal suction line at a coupling point disposed above said pivot axis, said dirt chamber being connected to said rear connection piece.

3. The rotor spinning apparatus according to claim 2, wherein said connection piece and said dirt removal suction line each have a flange-like end region with sealing means being adapted to one another.

4. The rotor spinning apparatus according to claim 1, wherein said bearing is a support disk bearing disposed on said support frame, said support frame receiving said rotor housing, box walls securing said support frame to the machine frame of the spinning machine, and said box walls having outriggers on which said lid element is supported so as to be rotatable about said pivot axis.

5. The rotor spinning apparatus according to claim 4, wherein said lid element has fastening tabs with slit recesses formed therein, and said pivot axis is defined by short bolts being supported in bores formed in said outriggers and corresponding with said slit recesses.

6. The rotor spinning apparatus according to claim 5, including securing means locking said bolts inside said slit recess.

7. The rotor spinning apparatus according to claim 1, wherein said lid element has a front, and including respective drive means for said opening roller and for said sliver feed roller, said pivot axis and said drive means being disposed one behind the other at approximately the same height, as seen from said front of said lid element.

8. The rotor spinning apparatus according to claim 7, including a drive shaft being parallel to said pivot axis for sliver feeding, and a drive wharve of said opening roller, said drive means for said opening roller being a revolving tangential belt acting from below upon said drive wharve and being disposed between said pivot axis and said drive shaft.

9. In a spinning machine having a frame, a rotor spinning apparatus, comprising:

a support frame stationarily disposed on the frame of the spinning machine;

a support disk bearing disposed on said support frame;

a spinning rotor being disposed on said bearing and having a rotor axis and a rotor opening;

a rotor housing surrounding said spinning rotor;

a lid element pivotally supported about a pivot axis, said pivot axis being oriented orthogonally to said rotor axis and being disposed approximately vertically beneath said rotor opening, said lid element covering said rotor housing, and said lid element having a sliver feed roller, an opening roller, a fiber guide channel plunging into said rotor opening, a yarn draw-off opening, and a dirt separator;

said support frame receiving said rotor housing, box walls securing said support frame to the machine frame of the spinning machine, and said box walls having outriggers on which said lid element is supported so as to be rotatable about said pivot axis; and said lid element having fastening tabs with slit recesses formed therein, and said pivot axis being defined by short bolts supported in bores formed in said outriggers and corresponding with said slit recesses.

10. The rotor spinning apparatus according to claim 9, including securing means locking said bolts inside said slit recess.

11. In a spinning machine having a frame, a rotor spinning apparatus, comprising:

a support frame stationarily disposed on the frame of the spinning machine;

a support disk bearing disposed on said support frame;

a spinning rotor being disposed on said bearing and having a rotor axis and a rotor opening;

a rotor housing surrounding said spinning rotor;

a lid element having a front and being pivotally supported about a pivot axis, said pivot axis being oriented orthogonally to said rotor axis and being disposed approximately vertically beneath said rotor opening, said lid element covering said rotor housing, and said lid element having a sliver feed roller, an opening roller, a fiber guide channel plunging into said rotor opening, a yarn draw-off opening, and a dirt separator; and respective drive means for said opening roller and for said sliver feed roller, said pivot axis and said drive means being disposed one behind the other at approximately the same height, as seen from said front of said lid element.

12. The rotor spinning apparatus according to claim 11, including a drive shaft being parallel to said pivot axis for sliver feeding, and a drive wharve of said opening roller, said drive means for said opening roller being a revolving tangential belt acting from below upon said drive wharve and being disposed between said pivot axis and said drive shaft.

* * * * *